US006004054A

United States Patent [19]

Wei-Pin

[11] Patent Number: 6,004,054

[45] Date of Patent: Dec. 21, 1999

[54] LIPSTICK HOLDER

[76] Inventor: Lin Wei-Pin, No. 631, Sec. 7, Jang-Loh Rd., Lu Kang, Chang Hua Hsien, Taiwan

[21] Appl. No.: 09/099,243

[22] Filed: Jun. 17, 1998

[51] Int. Cl.[6] ..... B43K 21/08

[52] U.S. Cl. ..... 401/78; 401/87

[58] Field of Search ..... 401/78, 87, 86, 401/75

[56] References Cited

U.S. PATENT DOCUMENTS

| | | | |
|---|---|---|---|
| 4,208,144 | 6/1980 | Idec et al. | 401/192 |
| 4,750,882 | 6/1988 | Bouix | 401/78 |
| 4,983,059 | 1/1991 | Holloway | 401/78 |
| 5,186,560 | 2/1993 | Holloway | 401/78 |

*Primary Examiner*—Henry J. Recla
*Assistant Examiner*—Peter deVore
*Attorney, Agent, or Firm*—Harrison & Egbert

[57] ABSTRACT

A lipstick holder is composed of a main base provided at one end thereof with a central base. The central base is fastened with a slide seat from the bottom so as to enable the slide seat together with the central base to be fastened with the main base, and enable the top end of the central base to be rather high in an appropriate distance at the top end of the main base. A cap is further fastened with the main base at one end thereof. The thread in the inner wall of the main base is engaged with the protuberance piece of the slide seat. The retaining ring of the central base is engaged with the halved ring of the main base.

1 Claim, 6 Drawing Sheets

LIPSTICK HOLDER

FIELD OF THE INVENTION

The present invention relates generally to a holder, and more particularly to a lipstick holder.

BACKGROUND OF THE INVENTION

As shown in FIGS. 1 and 2, a prior art lipstick holder consists of a base 10, swivel seat 11, receiving slot 12, guide tube 13, sleeve 14, and a cap 15. When installed, the bottom of the swivel seat 11 is fastened firmly with the base 10 and the receiving slot 12 provided therewith by pressing so as to enable the protuberance grain 121 to enter into the swivel seat 11 and extend through long hole 111. The guide tube 13 is provided with the thread 131 fastened firmly with the sleeve 14 so as to enable the swivel seat 11 and the receiving slot 12 to be engaged pivotally with the guide tube 13, the protuberance grain 121 of the receiving slot 12 being fastened pivotally with the thread 131 of the guide tube 13. The cap 15 is fastened with the sleeve 14 and further engaged pivotally with the base 10.

Such a prior art lipstick holder as described above is defective in design with its complicated structures and is not cost-effective.

SUMMARY OF THE INVENTION

The primary objective of the present invention is therefore to provide a simple, cost effective lipstick holder having a main base, a central base, and a slide seat.

The objective, features and functions of the present invention will be readily understood upon a thoughtful deliberation of the following detailed description of the present invention with reference to the accompanying drawings.

DETAILED DESCRIPTION OF THE EMBODIMENT

Figure 1:
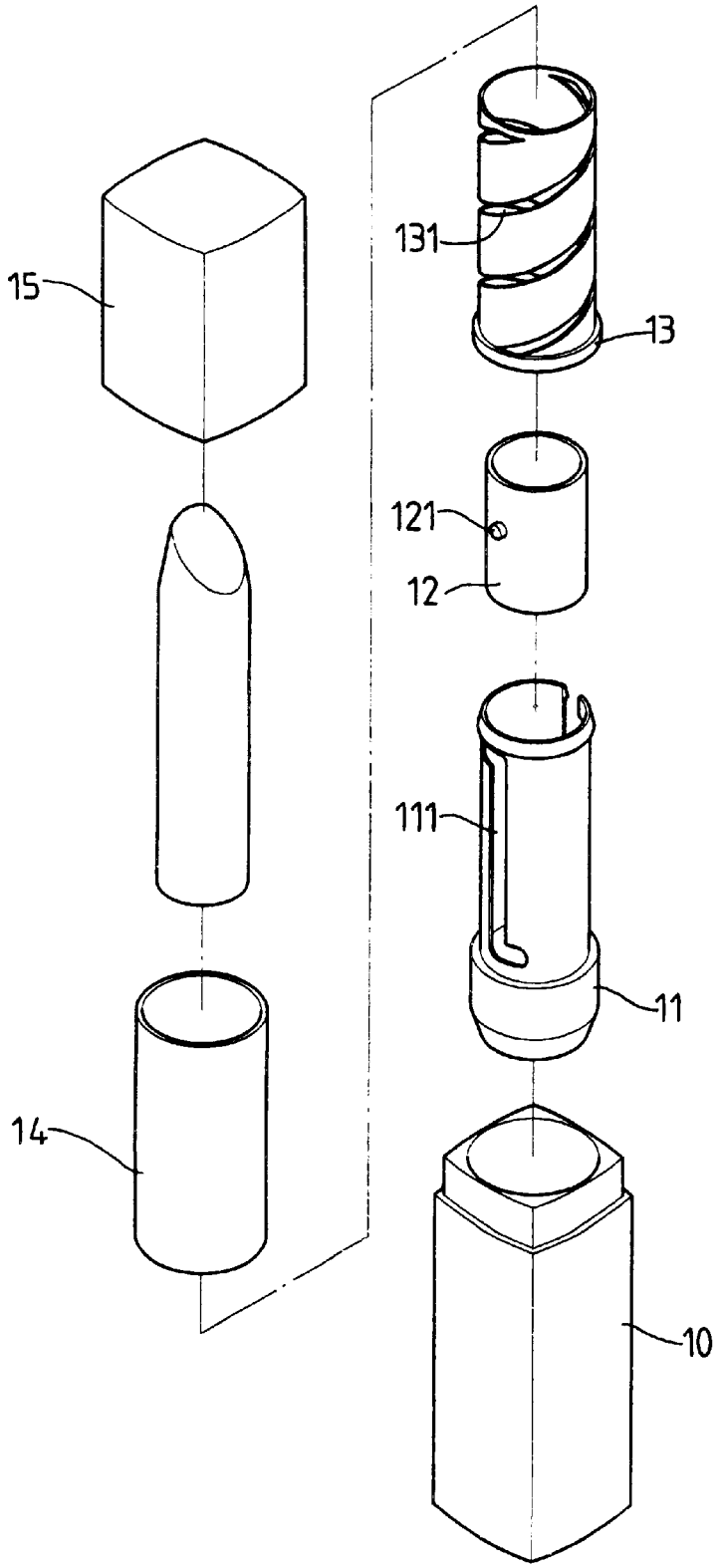
FIG.1 PRIOR ART
FIG. 1 shows an exploded view of the prior art lipstick holder.
Figure 2:
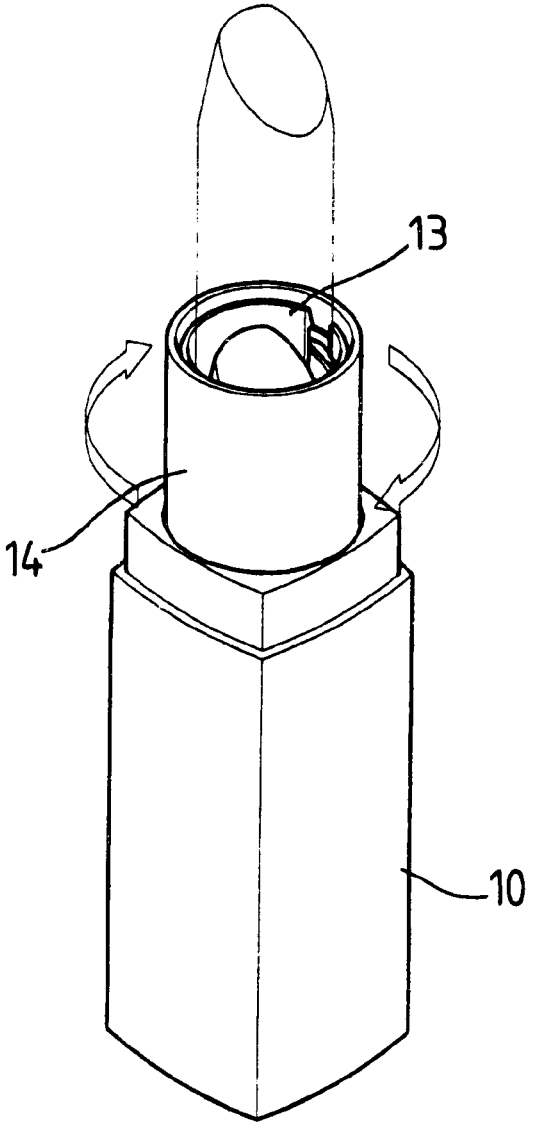
FIG.2 PRIOR ART
FIG. 2 shows a schematic view of the prior art lipstick holder in operation.
Figure 3:
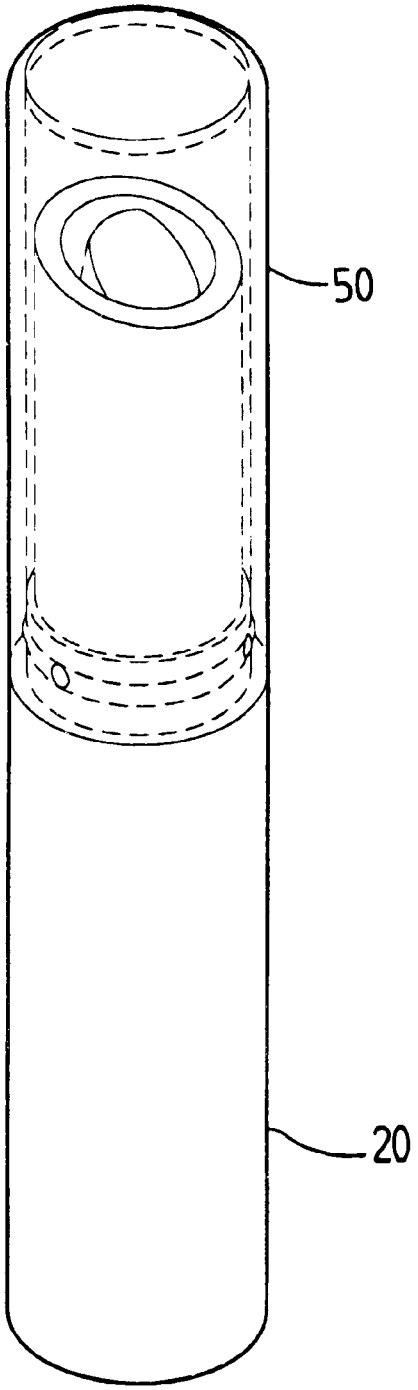
FIG. 3 shows a perspective view of the present invention in combination.
Figure 4:
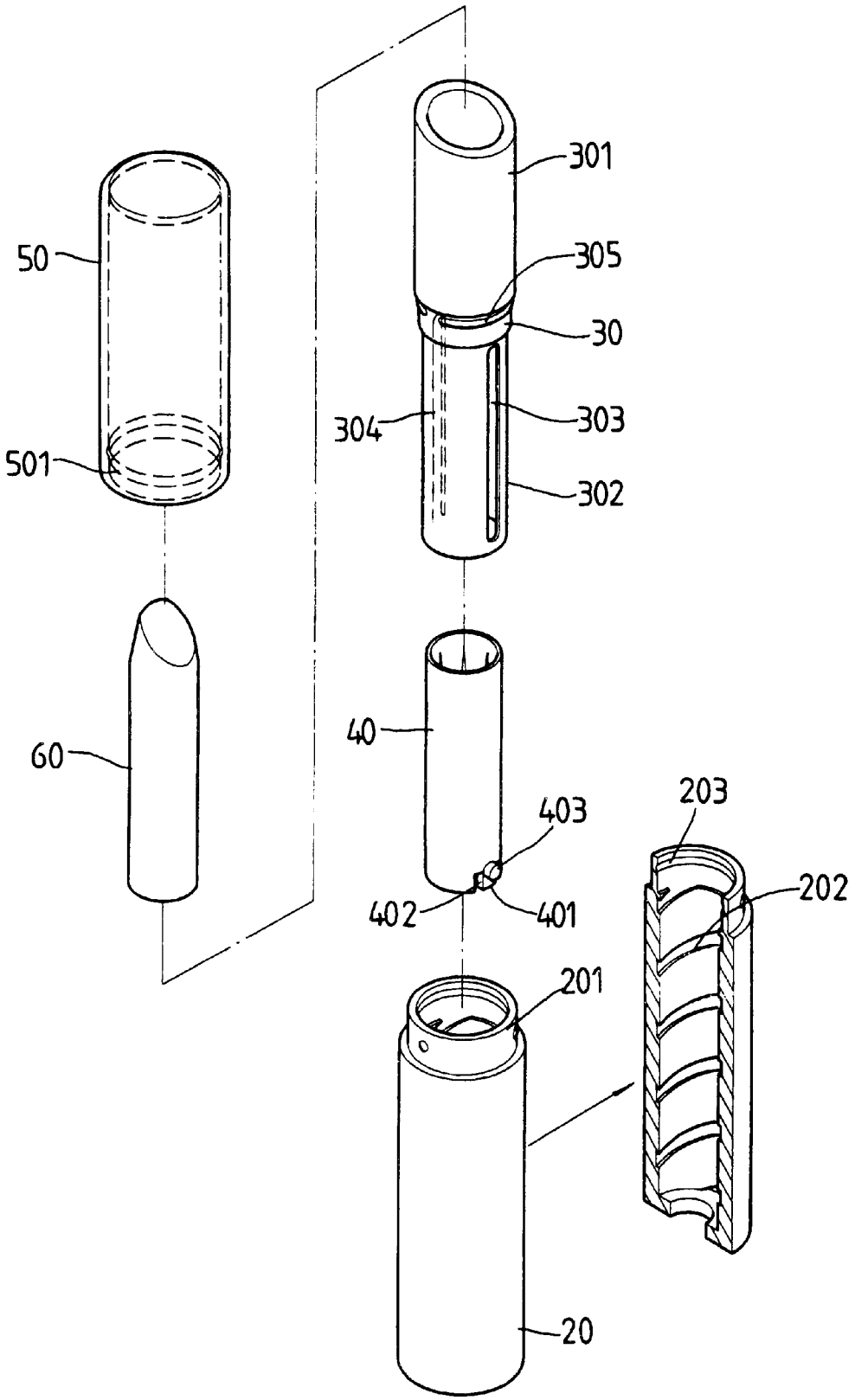
FIG. 4 shows an exploded view of the present invention.

As shown in FIGS. 3 and 4, a lipstick holder embodied in the present invention is composed of a main base 20 provided with a tube 201 at the end thereof. The main base is provided with a thread 202 in the inner wall of the main base 20. A annular recess 203 is provided inside the tube 201.

The lipstick holder further includes a central base 30 divided from the middle fastened with an upper tube 301 and a lower tube 302. At the both sides of the lower tube 302 there are two vertical holes which one 303 is closed at the bottom end and the other 304 is opened. The outer wall of the central base 30 is provided with a retaining ring 305.

The lipstick holder further includes a slide seat 40 provided with an inner space for receiving a lipstick 60 from the top end thereof and further provided with a fragment 401 at the bottom end thereof. A trough 402 is fastened therewith on the fragment 401. The fragment 401 has an interior of reducing diameter. Two protuberance pieces 403 are fastened on the fragment 401.

The lipstick holder further includes a cap 50 having an inner space provided with an opening 501 at the bottom end thereof.

With the structure as described above, the top end of the slide seat 40 is fastened with the lower tube 302 of the central base 30. Both sides of fragment 401 at the bottom end of the slide seat 40 are pressed to shrinkage so as to enable the protuberance pieces 403 to be engaged with the one side vertical hole 303 and the other side vertical hole 304 of the central base 30. Moreover, the bottom end of the lower tube 302 of the central base 30 is fastened with the main base 20 at one end thereof. The retaining ring 305 of the central base 30 is engaged with the annular recess 203 of the main base 20. The protuberance pieces 403 of the slide seat 40 are engaged with the threads 202 in the inner wall of the main base 20. The cap 50 is engaged with the main base 20 at one end thereof.

Figure 5:
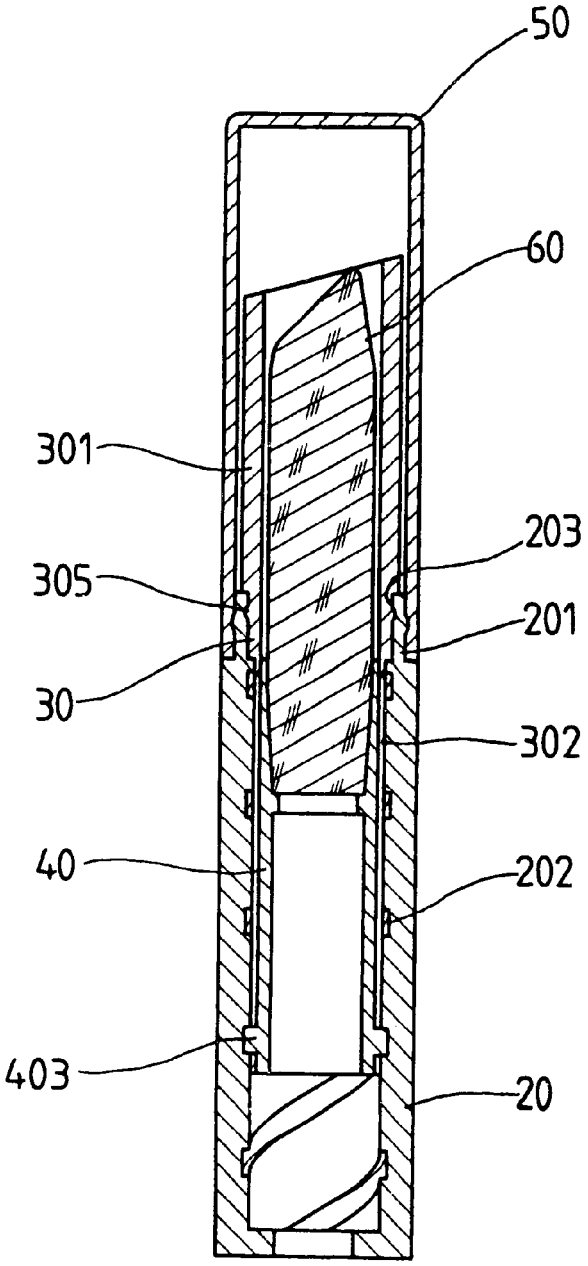
FIG. 5 shows a sectional view of the present invention in combination.
Figure 6:
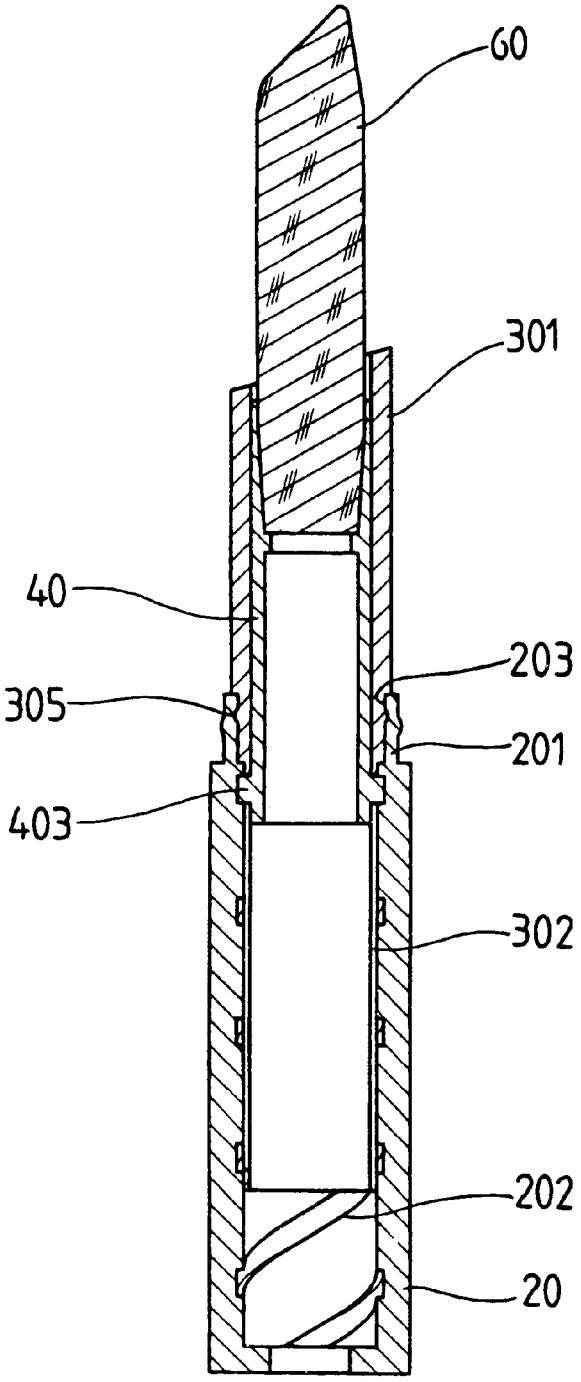
FIG. 6 shows a schematic view of the present invention in operation.

As shown in FIGS. 5 and 6, the threads 202 are formed directly in the inner wall of the main base 20. The fragment 401 of the slide seat 40 has an elasticity so as to enable engagement with the vertical holes 303 and 304 of the central base 30. The central base 30 together with the slide seat 40 are both engaged with the main base 20.

The embodiment of the present invention described above is to be deemed in all respects as being illustrative and not restrictive. Accordingly, the present invention may be embodied in other specific forms without deviating from the spirit thereof. The present invention is therefore to be limited only by the scopes of the following appended claim.

I claim:

1. A lipstick holder comprising:

a main base having a tubular portion at one end thereof, said tubular portion having an annular recess in an inner wall thereof, said main base having a thread formed integrally in said inner wall and positioned below said annular recess;

a central base having an upper tube and a lower tube, said lower tube having vertical slots formed at opposite sides thereof, said vertical slots extending longitudinally and entirely linearly along said lower tube, one of said vertical slots being closed at a bottom end thereof, another of said vertical slots opening at said bottom end, said lower tube of said central base having a retaining ring formed at an upper end thereof, said retaining ring received by said annular recess of said main base, said upper tube adapted to allow a lipstick to pass therethrough;

a slide seat having an interior opening at one end adapted to receive the lipstick therein, said slide seat having a fragment at an opposite end thereof, said fragment having a trough adapted to cause said fragment to be pressed to shrinkage, said fragment having protuberance pieces at opposite sides thereof, said protuberance pieces slidably positioned respectively through said vertical slots of said central base, said protuberance pieces engaging said thread of said main base; and a cap having an interior area with an opening at an end thereon, said cap releasably engaged with said one end of main base.

* * * * *